United States Patent [19]

Würker

[11] 4,041,201

[45] Aug. 9, 1977

[54] ADHESIVE STRIP SET FOR SPLICING FILM STRIPS

[76] Inventor: Carl H. Würker, D 7239 Oberndorf-Aistaig, Schwarzwald, Germany

[21] Appl. No.: 632,058

[22] Filed: Nov. 14, 1975

[30] Foreign Application Priority Data

Nov. 16, 1974 Germany ..... 7438280

[51] Int. Cl.[2] ..... G03D 15/04

[52] U.S. Cl. ..... 428/40; 156/157; 352/239; 428/124; 428/137

[58] Field of Search ..... 428/41–43, 428/61, 189; 156/159, 157; 242/58.1, 58.5; 352/229, 233, 235, 237, 239, 244

[56] References Cited

U.S. PATENT DOCUMENTS

| | | | |
|---|---|---|---|
| 2,940,884 | 6/1960 | White | 352/244 |
| 3,297,398 | 1/1967 | Donofrio | 352/233 |
| 3,475,263 | 10/1969 | Kapilow et al. | 156/157 |
| 3,503,834 | 3/1970 | Schroter | 428/42 |
| 3,737,364 | 6/1973 | Heindl | 428/42 |

*Primary Examiner*—George F. Lesmes
*Assistant Examiner*—R. J. Roche
*Attorney, Agent, or Firm*—Roylance, Abrams, Berdo & Kaul

[57] ABSTRACT

An adhesive strip set for splicing motion picture film strips having edge locations for sound and compensating tracks including a first splicing patch or foil dimensioned to fit between the tracks, a second foil to fit the side of the film strip opposite the side having the tracks, adhesive layers on both sides of the foils, a holding strip to retain the foils in proper relative positions[1)], and masking strips to cover the adhesive surfaces on the other sides of the foils which are to adhere to the film strip until use. In a second embodiment the strip set is made in two parts with holding and masking strips for each foil.

[1)] and bearing the adhesive layers on the one sides of the foils

6 Claims, 7 Drawing Figures

ADHESIVE STRIP SET FOR SPLICING FILM STRIPS

This invention relates to adhesive strip sets or patches for splicing film such as motion picture film, and particularly for splicing sound motion picture film.

It is common practice at the present time to butt-splice film strips, including motion picture film, using adhesive patches which are provided in the form of adhesive strip sets which are applied to both sides of the film strip after the strip has been appropriately aligned and trimmed. One example of a prior art strip set of this general nature is shown in U.S. Pat. No. 3,424,644, Nakagome. In that patent is shown a patch of film or foil which carries on one surface a layer of pressure-sensitive adhesive. The adhesive is covered by removable release paper masking strips and has centrally located perforations to match and be aligned with the sprocket holes along the film. The holes in the patch are approximately the same dimension as the sprocket holes in the longitudinal direction of the film strip but are significantly larger than the sprocket holes in the width direction of the film strip, i.e., transverse to the longitudinal direction. One half of the patch is applied to one surface of the film and the masking strip covering that half is removed, permitting the patch to be applied to that first side of the film strip straddling the trimmed abutting ends. The film strip is then turned over and the patch is folded around the edge of the film so that the remaining portion of the patch can be adhered to the opposite side of the film strip. In the case of sound film which is provided with a sound track and a compensating track wherein the tracks are disposed along opposite edges of the film, at least one of the tracks is necessarily covered by that portion of the patch which extends around one edge of the film and, in the case of the Nakagome structure, the patch would normally cover both such tracks. As a result, at least one of these tracks is covered with the result that the sound film detection head is spaced farther from the track in the vicinity of the splice than it is along the remainder of the film strip. In those cases wherein the compensating track is applied to the film after splicing, such track does not properly adhere to the exposed surface of the splicing patch. Variations in the sound therefore occur when the spliced film is used.

In another prior art effort to produce a suitable splice, illustrated in British Pat. No. 900,643 (published July 11, 1962), there is provided a separate adhesive patch for each side of the film strip. The two patches are related to each other by means of a support member or, alternatively, each patch resides on its own support member. A release paper masking strip is supplied to keep the two patches from sticking to each other before application. In use, the film strip ends which are to be spliced in abutting relationship must be applied directly to the exposed adhesive surface of one of the patches after removal of the release paper masking strip which makes it extremely difficult to properly align the film in a precision fashion. Accordingly, it is an object of the present invention to provide an improved adhesive strip set which is particularly useful with sound motion picture film and which permits precision splicing of the film without obstruction of or interference with the sound tracks recorded, or to be subsequently placed, along the edges of the film.

Briefly described, the invention includes an adhesive strip set for splicing abutting ends of motion picture film strip portions of the type having sprocket holes and having a sound track and a compensating track along opposite edges of one surface thereof, comprising a first foil to be adhered to the surface of the film strip portions having the sound and compensating tracks; a second foil to be adhered to the opposite surface of the film strip portions, each of the first and second foils having a coating of pressure-sensitive adhesive on both surfaces thereof, the width of the first foil being less than the distance between the sound and compensating tracks; first and second separate, releasable masking strip means for covering the adhesive coatings on the surfaces of the first and second foils to be placed adjacent the film strip portions, respectively; and third holding and masking strip means for covering the adhesive coatings on the opposite surfaces of the first and second foils. The third holding and masking strip means would normally include means defining apertures for aligning the foils with the sprocket holes in the film strip portions. The third masking strip means can constitute a single common holding strip for supporting both foils in parallel relationship to each other, this common holding strip being removable after the foils are adhered to opposite sides of the film strip portions. Alternatively, the third means can include third and fourth separate releasable holding strips for masking the adhesive coatings on the foil, each of these third and fourth strips having a dimension transverse to the film strip portions significantly greater than either of the foils. The first and second strip means can include a strip portion adjacent one of the foils, a reversely directed portion extending beyond the outer margin of its respective foil, and a bent portion joining the strip and reversely directed portions, the bent portion having means defining apertures in registry with the apertures in the third masking strip means.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
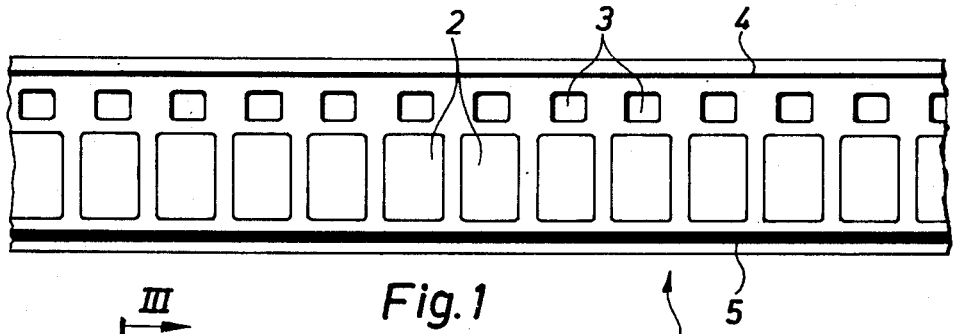
FIG. 1 is a plan view of the top surface of a film strip of the type to be spliced using an adhesive strip set according to the present invention.

FIG. 1 shows an enlarged view of a typical film strip which has a series of picture frames 2 which are longitudinally distributed along the film strip in an equally-spaced array. A plurality of sprocket holes are disposed along a parallel to the picture frames, each picture having a hole 3 assigned to it. The sprocket holes are dimensioned and appropriately spaced to engage a sprocket wheel or gripping device, not shown, to advance the film strip in a conventional and well understood manner. The edge portions of the film strip can receive, or be provided with, a compensating track 4 and a sound track 5, these being along opposite edges of the film. Normally, the compensating track 4 is narrower than sound track 5.

As is well known, film of this type is spliced in editing or repair by severing the film along a line perpendicular to the longitudinal direction of the film as by an apparatus such as that shown in U.S. Pat. No. 3,709,079. As previously indicated, it is desirable to splice the film in a manner such that the compensating track and the sound track areas are free of the adhesive foil or patch used to splice the film in order to make it possible to achieve the same sound pickup in the spliced regions as is achieved in the remainder of the film strip. it is also possible to apply the sound or compensating tracks, after splicing, along the lines designated for that purpose.

Figure 2:
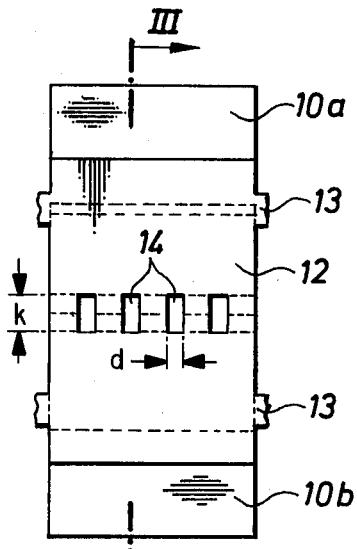
FIG. 2 shows a plan view of a first embodiment of an adhesive strip set according to the present invention.
Figure 3:
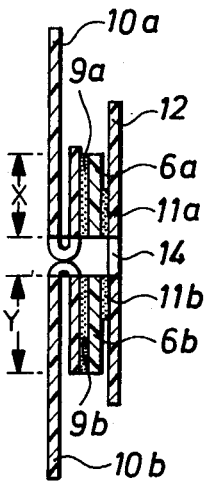
FIG. 3 is a side elevation, in section, along lines III—III of FIG. 2.

FIGS. 2 and 3 show a first embodiment of an adhesive strip set in accordance with the invention for connecting two abutting ends of the film strip which, as they are held in a splicing device, are adjacent and touching each other. The adhesive strip set includes first and second adhesive foils 6*a* and 6*b* which are made of transparent and strong material, and in particular a transparent plastic material, having a dimension in the longitudinal direction of the film strip approximately equal to the length of either two or four picture frames along the strip. The dimension of the foils in the transverse direction of the film strip are different. As will be seen in FIG. 3, the dimension X of foil 6*a* is smaller than the dimension Y of foil 6*b*, dimension Y being approximately equal to the transverse dimension of the film strip and dimension X being equal to or less than the transverse spacing between tracks 4 and 5. Normally, foil 6*a* would be applied to the glossy side of film strip 1 which is the side normally provided with compensating and sound tracks 4 and 5, but in those cases where the sound track is applied to the opposite side of the film, the same basic arrangement of the adhesive strip set can be used.

Each of the foils 6*a* and 6*b* is provided on one side with an adhesive layer or coating 9*a* and 9*b*, respectively. Coating 9*a* is masked by a masking strip 10*a* which extends across coating 9*a* and protrudes inwardly beyond the inner edge of foil 6*a*, and then bends in the reverse direction to form an elongated outwardly extending end portion which can be grasped by the user to remove the masking strip from the adhesive coated surface of the foil. On the opposite surfaces of foils 6*a* and 6*b* are provided adhesive layers ll*a* and 11*b*, respectively, which are attached upon a holding strip 12 which serves the purpose of combining foils 6*a* and 6*b* with their masking strips 10*a* and 10*b* to form an adhesive strip set wherein the foils are properly spaced apart and held in the desired relationship. Holding strip 12 is provided with a plurality of apertures 14 having a longitudinal dimension *d* which is usually somewhat larger than the longitudinal dimension of sprocket hole 3 in film strip 1, and having a transverse dimension *k* which is several times the transverse width of hole 3. As a result of this arrangement, when the strip set is folded around the edge of strip 1 nearest track 4, the holes 3 on both sides of the film are unobstructed by the strip set.

In the usual assembly of adhesive strip sets containing the foils and masking and holding strips described in connection with FIGS. 2 and 3, a plurality of such sets are manufactured in an elongated series of such sets which are connected to each other by relatively small strap portions 13 which can easily be fractured to separate the strip sets from each other. Masking strips 10*a* and 10*b* consist of a release paper or plastic material which can be coated with a silicone composition of a conventional type to permit them to be easily removed from the adhesive layers. Similarly, holding strip 12 consists of plastic or paper material of a release type or having a release coating, strip 12 having sufficient strength to permit folding and removal of strips 10*a* and 10*b* while maintaining the splicing foils in proper relationship. Adhesive layer 11*a* and 11*b* are selected, in conjunction with the foil and holding strip materials, so that the adhesive layers adhere more firmly to holding strip 12 than to the adhesive foils 6*a* and 6*b*. Adhesive layers 9*a* and 9*b* are selected to adhere to the adhesive foils more strongly than to the masking strips 10*a* and 10*b*, this selection of materials having different tack strengths being well known in the art.

Masking strips 10*a* and 10*b*, the bent portions of which touch each other are apertured in alignment with the apertures in holding strip 12 and can serve to mask the adhesive layers 11*a* and 11*b* in the middle of holding strip 12 if those layers are widened so that they extend across the portions separating apertures 14. Normally, the adhesive layers 11*a* and 11*b* do not reach as far as the edges of the adhesive foils.

As previously mentioned, the contact point of the two masking tapes 10*a* and 10*b* is located so that it lies approximately in the center of aperture 14. To a limited extent, adhesive layer 9*b* of foil 6*b* can also be masked by strip 10*a* which masks the adhesive layer 9*a* of adhesive foil 6*a* completely. Strip 10*a* may also reach only as far as adhesive foil 6*a*. The areas of the masking strips 10*a* and 10*b* adjoining the adhesive layers 9*a* and 9*b* may be slightly extended beyond the edges of foils 6*a* and 6*b* which are turned away from each other.

To apply foils 6*a* and 6*b* to the abutting ends of the portions of film strip 1 which are to be connected to each other, a device, not shown, such as the splicing apparatus shown in U.S. Pat. No. 3,709,079, is employed. In that apparatus, film strip 1 is inserted with its glossy side on top and is aligned by means of sprocket holes 3. The adhesive strip set is then placed over the abutting ends of the film strip in a position rotated 180° about an axis through one of apertures 14 from the position shown in FIG. 3 and is placed with foil 6*a* adjacent the surface of the film, masking strip 10*a* still being in place as shown in FIG. 3. The set is aligned with the film such that apertures 14 are aligned with sprocket holes 3 so that the apertures determine the position of foil 6*a* between the sound and compensating tracks. Masking strip 10*a* is then removed by grasping the protruding end thereof and pulling it from between the foil and film strip. The foil 6*a* is then pressed onto the film and is adhered thereto by layer 9*a* in such a way that the sound and compensating tracks are not covered. Thereafter, film strip 1 is inverted, together with the adhesive strip set, and holding strip 12 is folded around the edge of film strip 1 adjacent holes 3 and compensating track 4 in such a way that the other end of apertures 14 is aligned with sprocket holes 3 of the film strip and so that adhesive foil 6*b* covers the film strip. Strip 10*b* is then pulled off in the same manner as strip 10*a* and foil 6*b* is adhered to the other side of film strip 1 by means of adhesive coating 9*b*.

The spliced portion of film strip 1, now being adhered to the foils, is removed from the splicing device and the foils 6*a* and 6*b* are firmly pressed onto strip 1. Thereafter, holding strip 12 is removed from foils 6*a* and 6*b*, leaving the splice complete. Adhesive layers 11*a* and 11*b* are removed along with holding strip 12. It will be observed that this adhesive strip set according to FIGS.

2 and 3 is applied in a manner similar to that shown in U.S. Pat. No. 3,424,644, but with the advantages of not obscuring sound track portions or having sections remaining around the edge of the film.

Figure 4:
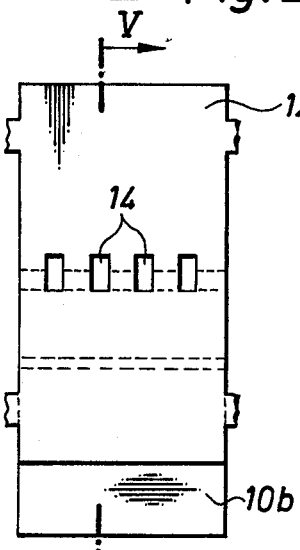
FIG. 4 and FIG. 6 are plan views of first and second portions of a second embodiment of the invention.
Figure 5:
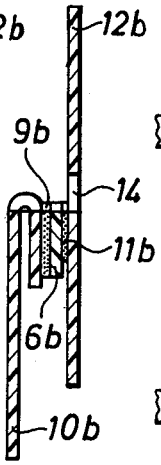
FIGS. 5 and 7 are side elevation views, in section, along lines V—V and VII—VII of FIGS. 4 and 6, respectively.
Figure 6:
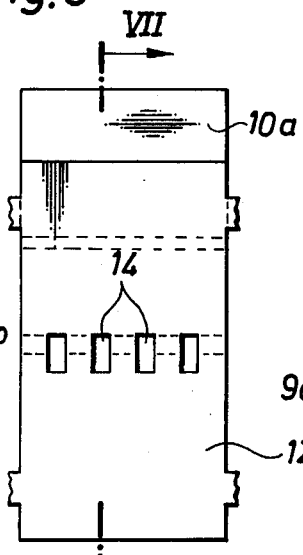
Figure 7:
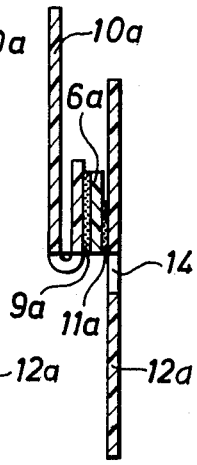

A further embodiment according to the invention is shown in FIGS. 4–7, this embodiment constituting a two-part adhesive strip set to splice film ends wherein adhesive foils 6*a* and 6*b* are provided for the two sides of film strip 1. In either of the embodiments shown the narrower adhesive foil 6*a* (FIG. 7) can have an edge formed for engaging the film strip between holes 3, the edge resembling a serrated edge. Foil 6*b* (FIG. 5) has holes or recesses corresponding to the sprocket holes. A holding strip 12*b* is adhered to the outer surface of foil 6*b* by means of an adhesive layer 11*b* which can be arranged so that it lies only along the edges of foil 6*b*. The holding strip 12*b* can be formed in two parts, one part being affixed to each of the opposite edges of foil 6*b*, referring to those edges which lie longitudinally spaced apart with respect to the film strip. Holding strip 12*b*, foil 6*b* and masking strip 10*b* are provided with recesses 14. The portion of the adhesive strip containing the adhesive foil 6*a*, according to FIGS. 6 and 7, is formed in a similar fashion to the strip set containing foil 6*b*.

To connect the abutting ends of portions of film strip 1, the adhesive strip set is aligned using apertures 14 and is placed so that foil 6*a* with masking strip 10*a* still attached to it is placed against the glossy side of the film strip and so that the foil 6*a* lies between the compensating track 4 and sound track 5. Masking strip 10*a* is then pulled from between the foil and the film strip and foil 6*a* is pressed firmly against the film strip, being adhered thereto by coating 9*a*. After firm positioning of foil 6*a*, holding strip 12*a* is removed. The film strip is then turned over and the portion of the strip set shown in FIGS. 4 and 5 is placed on the other surface of the film strip so that foil 6*b* is properly positioned so that the edges thereof do not extend beyond the edges of film strip 1. Masking strip 10*b* is then removed and foil 6*b* is adhered to the film strip by adhesive coating 9*b*, after which the holding strip 12 is removed.

The masking strips 10*a* and 10*b* of FIGS. 5 and 7 need not be bent. However, if this is the case, the masking strips must be removed prior to the positioning of the respective foils in the appropriate locations so that apertures 14 are aligned with holes 3. After adhesion, holding strip 12 is removed, as previously described. while this technique is usable, it is less advantageous because of the potential inadvertent adhesion of the foil to the film strip.

As will be apparent, the film splicing apparatus of previously mentioned U.S. Pat. No. 3,709,079 can be employed in using the film strip set in accordance with FIGS. 4–7.

While certain advantageous embodiments have been chosen to illustrate the invention, it will be understood by those skilled in the art that various changes and modifications can be made therein without departing from the scope of the invention as defined in the appended claims.

What is claimed is:

1. An adhesive strip set for splicing abutting ends of motion picture film strip portions of the type having sprocket holes and having sound track and compensating track locations along opposite edges of one surface thereof comprising a first foil to be adhered to the surface of the film strip portions having the sound and compensating track locations a second foil to be adhered to the opposite surface of the film strip portions, each of said first and second foils having a coating of pressure-sensitive adhesive on each surface thereof, the width of said first foil being less than the distance between the sound and compensating track locations;

first and second separate, releasable masking strip means releasably adhered to coatings on one side of each of said first and second foils, respectively, for covering the adhesive coatings on the surfaces thereof which are to be placed adjacent the film strip portions, said first and second strip means being more easily releasable from said coatings than are said foils;

a third holding and masking strip releasably adhered to the coatings on the opposite surfaces of both of said first and second foils, the coatings adhering said third strip being removable from said foils with said third strip; and means defining apertures in said third strip, said apertures being longitudinally arranged in said third strip between said first and second foils to permit alignment of said strip set with the sprocket holes in the film so that one of said foils is properly positioned adjacent one surface of the film, said third means being foldable along line parallel with said apertures to position the other one of said foils adjacent the opposite surface of the film.

2. An adhesive strip set according to claim 1 wherein each of said first and second masking strip means includes means defining apertures in registry with the apertures in said third strip means for aligning said foils relative to the sprocket holes in the film strip portions.

3. An adhesive strip set according to claim 2 wherein each of said first and second strip means includes a strip portion adjacent one of said foils, a reversely directed portion extending beyond the outer margin of its respective foil, and a bent portion joining said strip and reversely directed portions, said bent portion having said means defining apertures in registry with the apertures in said third masking strip means.

4. A two-part adhesive strip set for splicing abutting ends of motion picture film strip portions of the type having sprocket holes and having sound track and compensating track locations along opposite edges of one surface thereof comprising a first strip set part including a first foil to be adhered to the surface of the film strip portions having the sound and compensating track locations, said first foil having a coating of pressure-sensitive adhesive on each surface thereof, the width of said first foil being less than the distance between the sound and compensating track locations, a first masking strip releasably adhered to one said coating on one surface of said first foil, a second masking strip releasably adhered to said coating on the opposite surface surface of said first foil, the coating adhering said second strip being removable from said foil with said second strip, and means defining apertures in said second strip to permit alignment thereof with the sprocket holes in the film; and a second strip set part including a second foil to be adhered to the opposite surface of the film strip portions from said first foil, said second foil having a coating of pressure-sensitive adhesive on each surface thereof, a third masking strip releasably adhered to one said coating on one surface of said second foil, a fourth masking strip releasably adhered to said coating on the opposite surface surface of said second foil, the coating adhering said fourth strip being removable from said second foil with said fourth strip, and means defining apertures in said fourth strip to permit alignment thereof with the sprocket holes in the film, each of said first, second, third and fourth masking strips being significantly wider than either of said first and second foils.

5. An adhesive strip set according to claim 4 wherein said first masking strip and said first foil include means defining apertures in registry with said apertures in said second masking strip for aligning said first foil relative to the sprocket holes in the film strip portions, and said third masking strip and said second foil include means defining apertures in registry with said apertures in said fourth masking strip for aligning said second foil relative to said sprocket holes.

6. An adhesive strip set according to claim 5 wherein each of said first and third strips includes a strip portion adjacent its associated one of said foils, a reversely directed portion extending beyond the outer margin of its respective foil, and a bent portion joining said strip and said reversely directed portions, said bent portion having said means defining apertures in registry with the apertures in said second and fourth masking strips, respectively.

* * * * *